US005573642A

United States Patent [19]

Begemann

[11] Patent Number: 5,573,642

[45] Date of Patent: Nov. 12, 1996

[54] METHOD AND DEVICE FOR EVENING OUT THE BASIC WEIGHT CROSS SECTION BY SECTIONING THE SCREEN CIRCUIT

[75] Inventor: Ulrich Begemann, Leonberg, Germany

[73] Assignee: J.M. Voith GmbH, Germany

[21] Appl. No.: 157,891

[22] Filed: Nov. 24, 1993

[30] Foreign Application Priority Data

Nov. 26, 1992 [DE] Germany ..... 42 39 647.6

[51] Int. Cl.[6] ..... D21F 1/66

[52] U.S. Cl. ..... 162/190; 162/264

[58] Field of Search ..... 162/190, 259, 162/252, 264, 322, 364, 363, 370, DIG. 10, 198, 183

[56] References Cited

U.S. PATENT DOCUMENTS 3,149,027 9/1964 Mih ..... 162/351

*Primary Examiner*—Brenda A. Lamb

*Attorney, Agent, or Firm*—Ostrolenk, Faber, Gerb & Soffen, LLP

[57] ABSTRACT

To regulate the basis weight cross section of the fiber suspension dispensed by the outlet of a headbox of a paper making machine onto the screen or screens of the following forming section, the headbox is sectioned across the width of the machine with individual first sections of fiber suspension across the width. The fiber suspension on the screen(s) in the following forming section is drained and the drained filtrate is collected in second sections respectively generally corresponding to the first sections of the headbox. The removed sectioned filtrate is recycled to the respective sections of the headbox and is mixed with the suspension normally entering the headbox to regulate and make more uniform the basis weight cross section of the fiber suspension.

12 Claims, 2 Drawing Sheets

METHOD AND DEVICE FOR EVENING OUT THE BASIC WEIGHT CROSS SECTION BY SECTIONING THE SCREEN CIRCUIT

BACKGROUND OF THE INVENTION

The invention relates to a headbox and part of the following forming section of a machine for manufacturing a paper web and particularly to reuse of filtrate drained from the suspension in the forming section and recycled to the headbox for evening out the basis weight cross section of the web being produced.

A headbox of a paper making machine delivers liquid pulp suspension through the headbox outlet and across the width of a screen or screens in the forming section which follows the headbox. A headbox may be designed to adjust the consistency and fiber orientation 15 cross section of the pulp suspension, at the latest ahead of the delivery slot of the headbox, in such manner that the basis weight cross section and fiber orientation adjustment of the paper web correspond to a desired or preset requirement over the entire width of the headbox. In other words, these are usually constant across the width.

During the operation of a paper machine, there are numerous disturbing factors that counteract the two requirements listed above. These factors include, for example, temperature fluctuations, pressure fluctuations, and manufacturing tolerances, as well as errors in the design or adjustment of the paper machine for the production processes beyond the headbox.

The prior art-describes techniques for influencing the cross section of a paper web across the width of the headbox.

DE 35 14 554, which corresponds to U.S. Pat. No. 4,888,094, proposes changing the pulp consistency locally, in other words adjusting the consistency at certain points across the width of the headbox as required. However, nothing is disclosed about how this is to be performed.

DE 40 19 593 A1, which corresponds to U.S. patent application Ser. No. 07/925,966, filed Aug. 5, 1992, recommends a procedure for making that adjustment of consistency. When the basis weight profile of the paper web deviates at a certain point on the web across the width of the headbox, the concentration $C_M$ of the sectional flow in question, and hence that of the flow coming from the mixer in question, must be changed accordingly. To accomplish this, the ratio $Q_H/Q_L$ of the volumes of the regulating flows supplied to the mixer must be changed. Regardless of the composition of the consistency deviation prevailing at a particular point in the paper web across the width of the machine, regulating flows with constant compositions are always used for correction. For example, $Q_L$ can be so called "filtrate," which is produced when the fiber web is dewatered and recycled through a system of pipes.

German Patent 29 42 966 or DE-OS 35 35 849 disclose changing the height of the delivery or outlet slot of the headbox, for example, by using threaded spindles to pivot or bend the upper lip of the slot. This allows changing the throughput of the suspension locally. At the same time, however, the direction of the flow is affected locally, and therefore the fiber orientation is affected locally as well. Local narrowing of the slot gives The fibers a different flow direction at the narrow points than at other points in the delivery slot. This means that although the consistency can be made uniform over the width of the delivery slot by this so called displacement regulation the previously good quality fiber orientation is destroyed again.

The inventor has recognized that a significant part of the deviation of the basis weight cross section from an ideal cross section is caused by nonuniform dewatering of the fiber web. The nonuniform dewatering can be attributed, for example, to nonuniform permeability of the screens in the screen, wire or forming section across the width of the machine. The nonuniform permeability causes quantities of the fibers and fillers that are removed from the fiber web to differ at each location or section across the width. This is related, however, not only to the absolute quantities of fibers and filler, but also to the relative amounts of fibers of different lengths and the amounts of fillers.

One reason for this phenomenon is that the quantities of fibers of different lengths and the quantities of fillers passing through the screen during the dewatering of paper webs depend upon a number of factors that can differ across the width of the machine. This is especially true of twin or two wire formers, in which the paper web is dewatered between two screens or wires. For example, one can see that the quantity of long fibers passing through a screen locally during sheet forming is a higher than average percentage.

Since the dewatering behavior of the screen or screens can be a non-steady-state process, a fiber web results whose basis weight cross section and composition cross section are not constant across the width and can change as a function of time.

In paper machines according to the prior art, the filtrate drained from the web through the screens, across the entire width of the machine, and at different points in the screen or forming section, is collected in a common container and is then returned to the system for reuse in the headbox. The consistency and composition of the recycled filtrate consequently corresponds to the averages of these characteristics of the filtrate produced over the width of the machine during dewatering, although the filtrate that is drained off in the forming section is different by sections or locations across the width. Hence, the filtrate that is returned to each section across the width of the headbox does not correspond in composition to the filtrate which passed through the screen ar the corresponding section during the dewatering process. Consequently, the composition of the fiber suspension at a given point does not necessarily correspond to the composition of the new material suspension which is being fed to the entire system.

SUMMARY OF THE INVENTION

The object of the invention is to reduce deviations of the pulp suspension composition cross section across the width of the headbox from the ideal state, which may be caused by differences in the dewatering or drainage of the fiber web at the forming section wire screen(s) and across the width.

This object is achieved by collecting the filtrate drained off the suspension locally at locations across the width of the machine following the headbox, e.g., in the forming section, and returning the filtrate collected at each location of the forming section to a corresponding location in the headbox across the width of the headbox where the recycled filtrate is mixed with newly arriving suspension at the respective location across the headbox.

As described above, an effective basis weight cross section correction can be effected by sectional changes in geometry or changes in pulp suspension density in the headbox. The composition of the fiber web across the width of the machine cannot be made uniform by any of the known measures.

During web draining or dewatering, if the filtrate $Q_{Li}$ passing through the screen is separately collected by sections or locations over the width of the machine and if the, collected filtrate is then added, at the same section across the width to the headbox, together with a material stream of constant composition and quantity $Q_{Hi}$, then after a finite buildup time, the filtrate $Q_{Li}$ is recycled and therefore has no influence on the property of the fiber web in the section in question. Composition and weight per unit area of the fiber web correspond to $Q_{Hi}$ and therefore are absolutely constant as assumed.

Changes in fiber orientation can be performed, for example, using the diaphragm of the headbox or by sectional changes in the total volume flow $Q_{Hi}+Q_{Li}$.

The operation of the invention is now described with reference to an example. The constant volume flows $Q_{Hi}$ are uniformly fed into each section of the headbox across the width of the machine. If, in one section across the width of the subsequent forming section, an over proportional number of short fibers pass through the screen during dewatering of the paper web, then an especially large number of short fibers must likewise be mixed with the constant volume flow $Q_{Hi}$ to the respective correspondingly located section across the headbox in order to produce a paper web with constant properties at all sections across the width of the machine. This required mixing is accomplished by transferring the filtrate flow drained or dewatered from the particular section in question across the width of the subsequent forming section and feeding it into the respective correspondingly located section of the headbox across the width. In other words, pulp material components that have passed through the screen in increased quantities in one section across the width can be found in a higher concentration in that section across the width in the circuit including the headbox and screen. Accordingly, material components that are retained in a section to a greater degree by the screen are present in smaller numbers in the circuit of that section.

The idea according to the invention has the following advantages:

- the paper web composition is uniform everywhere across the width of and along the length of the web;
- the basis weight cross section is constant across the width and along the web;
- a pulp material flow with low consistency need not be adjusted at all or may be adjusted only to a much lesser extent than is the case at present;
- influence on fiber orientation by adjusting the weight basis weight cross section is ruled out.

The method and the devices of the invention can be used for all headbox types, for example, single layer headboxes, multilayer headboxes, headboxes for gap formers, headboxes for elongated screens, etc.

BRIEF DESCRIPTION OF THE DRAWING

Other objects and features of the invention are described with reference to the drawings.

DESCRIPTION OF A PREFERRED EMBODIMENT

Figure 1:
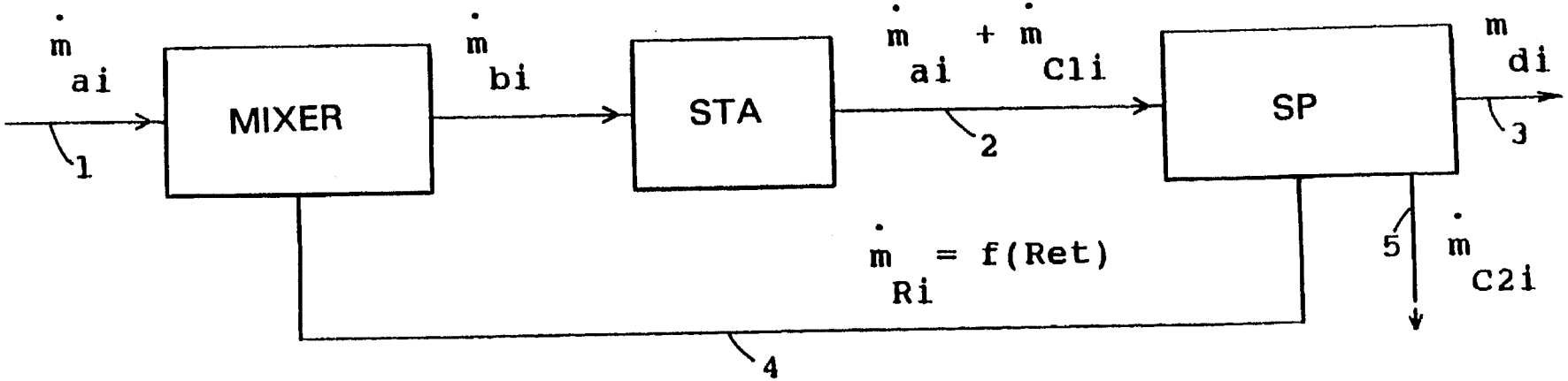
FIG. 1 shows schematically the solid material mass balance of a headbox with a screen part in a sectioned circuit.

Referring to FIG. 1 arrows 1 represents the solid material mass flow $m_{ai}$ entering one of the mixers located upstream of the headbox. This mixer can, for example, be the filtrate I holder or the mixing units described in DE 4 019 593 A1. Arrow 2 shows the mass flows $\dot{m}_{bi}=\dot{m}_{ai}+\dot{m}_{C1i}$ emerging from the exit from the headbox STA, which then enters the screen section or forming section SP which follows the headbox. Arrow 3 shows the mass flow $\dot{m}_{di}$, which emerges from the screen section, and that screen section simultaneously forms the web of paper. In addition, the mass flow $\dot{m}_{cli}$ from the screen section SP to the headbox STA is a function of the retention in section i. The relationship of flows is $\dot{m}_{ai}+\dot{m}_{cli}=\dot{m}_{di}+\dot{m}_{c2i}$.

If the solid material mass flow $\dot{m}_{c2i}$ which likewise emerges from screen section SP, by draining from it, is very much less than $\dot{m}_{c1i}$, then $\dot{m}_{di}=\dot{m}_{ai}$ is valid for the mass flow emerging from the screen section. In this case, the composition of the paper web is equal to the composition of the solid material mass flow $\dot{m}_{ai}$ and hence is constant over the width of the paper machine and is independent of disturbing factors in the screen section.

The assumption that $\dot{m}_{di}$ is very much smaller than $\dot{m}_{c1i}$ is usually correct since the corresponding material water amount $Q_{c2i}$ is always less than $Q_{C1i}$, and the consistencies $C_{1i}$ are as a rule greater than the consistencies $C_{2i}$.

Figure 2:
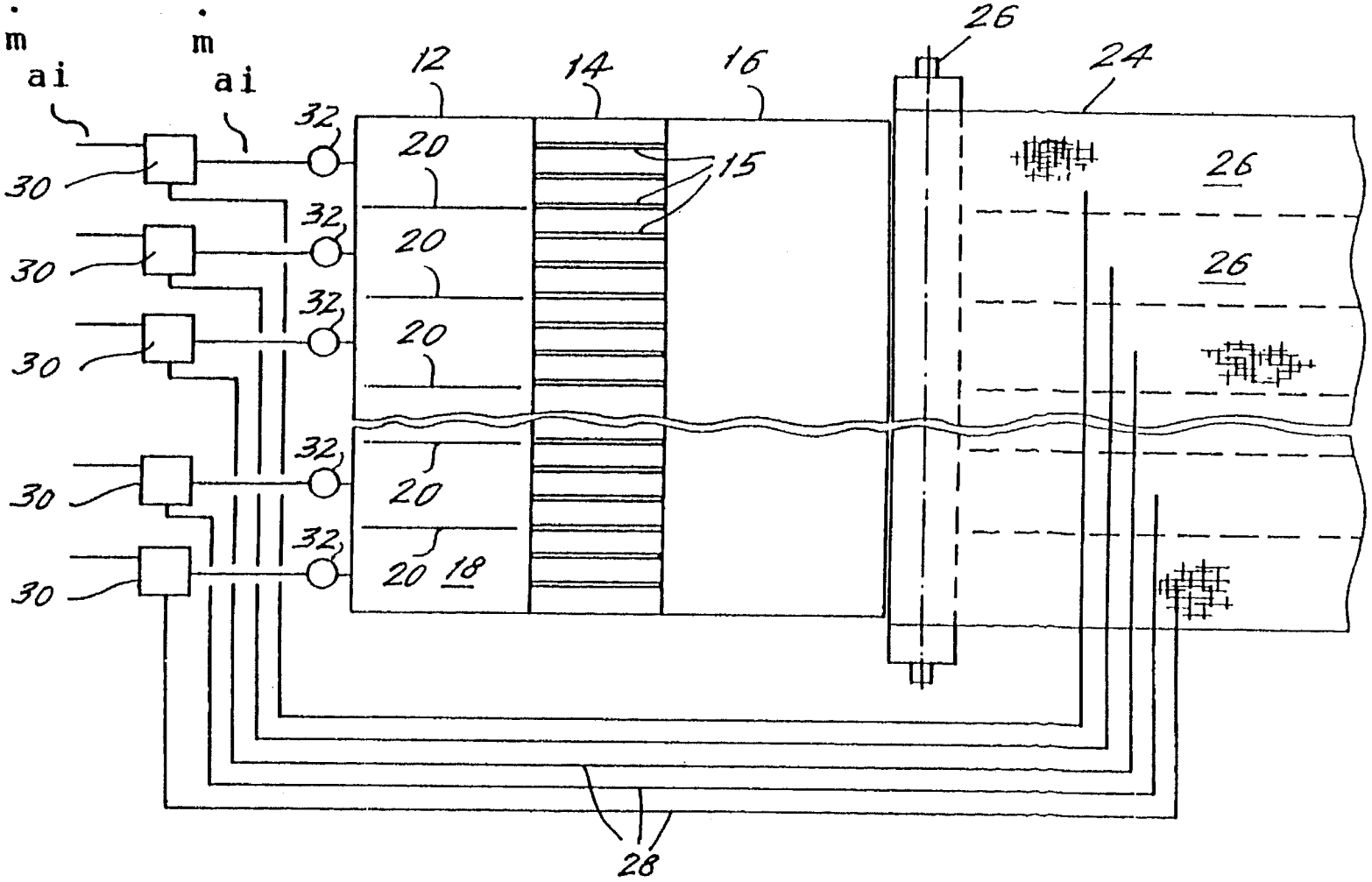
FIG. 2 schematically depicts the principle of the invention.

Apparatus embodying the invention is shown in FIG. 2. Headbox 10 is divided into sections 12, 14 and 16. Section 12 is the furthest upstream. It is again divided, in the cross stream or cross machine direction, into subsections by partitions 20. The partitions, however, are not an essential component of the headbox for defining the subsections. Downstream of the partitioned upstream section 12 there is a turbulence generating insert 14, which is in the form of a series of longitudinal channels 15, for example, in the present embodiment. Downstream of the insert 14 is a further section 16, which Constitutes the slice of the headbox, having a slice lip at the outlet.

Downstream of the entire headbox is a conventional forming section wire 24 or a pair of wires or wire screens on which or between which the headbox slice dispenses the suspension. The wire 24 travels over a breast roll 34. Wire 24 is itself divided in the cross machine direction, in the vicinity of the preliminary dewatering region on the wire, into sections 26 that correspond in number and cross machine location to the sections 18 of the headbox. The water $\dot{m}_{Ri}$ draining off the wire 24 is supplied section by section through respective return lines 28 that lead to a series of respective blenders 30. A supply of fresh suspension $\dot{m}_{ai}$ is simultaneously supplied to the blenders 30. The blenders 30 combine the two streams and supply them individually to the subsections of the upstream section 12 of the headbox 10 through flow regulators 32. The flow regulators 32 control how much of each blend is supplied to each subsection. It is also possible in accordance with the invention to position the flow regulators in the lines upstream of the mixers. It is also possible in accordance with the invention to position holding tanks (not shown) in the recirculation lines to compensate for any fluctuations in the backwater supply.

Material influencing fiber suspension quality, i.e. composition of the fiber suspension, can also be selectively introduced to sections of the headbox 10 Such fiber suspension quality influencing materials could include a retention agent which reduces the rate of liquid draining from the fiber suspension at the screen, or it could be an additional suspension whose composition differs from the suspension composition that has previously been added to the respective sections of the headbox for modifying the quality of the fiber suspension.

It is also anticipated by the present invention that the sectional filtration at sections 26 of section wire 24 may only be partially returned to corresponding sections of the headbox 10.

Further, the material for influencing the fiber suspension quality of the flows sent to headbox 10 can be added to the flows of filtrate drained from respective sections of sections 26 of section wire 24. The quantity and concentration of any added material to this flow of the filtrate from sections 26 may be adjusted to different levels in the respective sections over the width of the machine.

Although FIG. 2 illustrates for simplicity's sake only a single wire 24, according to the invention, it is possible to Use the method with a twin-wire machine and to divert the Water drained from both the upper and the lower wires 24i section 26 by section 26 to the respective subsections of the headbox 10.

It is possible to adjust the flow regulators 32 or vary the width of the channels 15 in the turbulence insert 14 in order to control the hydraulic impedance of the headbox and accordingly reorient the fibers.

The total volume of flow of each of the sections in the headbox 10 can be regulated. It is also possible to adjust the profile of the fiber orientation, the basis weight cross section, and the composition of selected sections across the width of the machine.

The kinetic or potential energy of the fiber suspension flow after that flow has passed through the section wire 24 can be used to return the sectioned filtrate flow to the respective sections of the headbox 10.

The advancing masses 3 and 5 illustrated in FIG. 1 are not essential to the device specified herein, in that the mass 3 is the paper itself and mass 5 is the water extracted from the paper which is not returned to circulation.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A method for evening out the basis weight profile of a fiber suspension used for producing a web in a paper making machine, comprising the following steps:

fiber suspension from an outlet of the paper making machine headbox and onto at least one screen through which liquid is drained from the fiber suspension in order to produce a web, wherein the headbox is divided into individual first sections arranged across the width of the machine and the fiber suspension is fed to first sections of the headbox and wherein the at least one screen is divided into individual second sections arranged across the width of the machine;

permitting the fiber suspension to lay on the at least one screen so that an amount of liquid in the fiber suspension drains through the at least one screen wherein the liquid is a filtrate and the filtrate which is drawn off the at least one screen is collected with respect to its position relative to the second section of the at least one screen from which the filtrate was drawn off producing a sectional filtrate, and wherein each of the second, sections in which the filtrate is drawn off at least generally corresponds in its position across the width of the machine to a respective first section of the headbox;

recycling the sectional filtrate from each second section to the respective corresponding first section of the headbox for mixing the recycled filtrate with the fiber suspension then being distributed by the respective first section of the headbox.

2. The method of claim 1, wherein that at least one screen is two screens and the step of uniformly distributing the fiber suspension from the headbox comprises distributing the fiber suspension from the headbox between the two screens and the sectional filtrate is collected from at least one of the two screens.

3. The method of claim 1, further comprising selectively supplying fiber suspension quality influencing material to the respective first sections of the headbox for influencing the fiber suspension being distributed from the first sections of the headbox.

4. The method of claim 3, wherein the fiber suspension quality influencing material comprises a retention agent which reduces the rage of liquid draining from the fiber suspension from the at least one screen.

5. The method of claim 3, wherein the fiber suspension quality influencing material comprises additional suspension with a composition different from a suspension composition then present in the respective first section of the headbox for modifying the fiber suspension quality.

6. The method of claim 1, wherein the sectional filtrate from each second section is, to the extent possible, returned completely to the respective corresponding first section of the headbox.

7. The method of claim 1, wherein the sectional filtrate is only partially returned to the corresponding first section of the headbox.

8. The method of claim 1, further comprising supplying fiber suspension quality influencing material to respective ones of the sectional filtrate drained from the screen.

9. The method of claim 8, wherein the quantity and concentrations of an added material in the sectional filtrate are adjusted to different levels in the respective first sections over the width of the machine.

10. The method of claim 1 further comprising regulating the total volume of flow of each of the first sections of the headbox, respectively.

11. The method of claim 10 further comprising adjusting the profile of the fiber orientation and the composition of the fiber suspension with respect to the first sections across the width of the machine.

12. The method of claim 1, further comprising using the kinetic or potential energy of a flow of fiber suspension after that flow has passed through the second sections of the at least the screen to return the sectional filtrate flow to the first sections of the headbox.

* * * * *